United States Patent [19]

Pakogian

[11] 4,274,635

[45] Jun. 23, 1981

[54] COMBINATION SOCCER/HOCKEY GAME BOARD

[76] Inventor: Sarkis B. Pakogian, P.O. Box 9440, Alexandria, Va. 22304

[21] Appl. No.: 118,871

[22] Filed: Feb. 6, 1980

[51] Int. Cl.[3] ..... A63F 7/06; A63F 7/36

[52] U.S. Cl. ..... 273/85 R

[58] Field of Search ..... 273/85 R, 85 A, 85 B, 273/85 E, 85 F, 85 H, 108–126

[56] References Cited

U.S. PATENT DOCUMENTS

| | | | |
|---|---|---|---|
| 1,504,605 | 8/1924 | Clausen | 273/85 R |
| 1,624,469 | 4/1927 | Brown | 273/85 R |
| 3,406,970 | 10/1968 | Webb, Jr. | 273/85 H |

FOREIGN PATENT DOCUMENTS

| | | | |
|---|---|---|---|
| 532592 | 11/1956 | Canada | 273/85 R |
| 1009590 | 3/1952 | France | 273/85 R |
| 472647 | 6/1952 | Italy | 273/85 R |
| 9386 | of 1895 | United Kingdom | 273/85R |
| 384477 | 12/1932 | United Kingdom | 273/85 R |

*Primary Examiner*—Paul E. Shapiro

*Attorney, Agent, or Firm*—Henderson & Sturm

[57] ABSTRACT

This invention relates to rolling sphere game boards in general, and more specifically to a game board for simulating either a hockey rink or soccer field which contains a plurality of stationary spaced obstructions positioned on the game board in such a manner to allow both unimpeded and restricted travel of a sphere propelled by one player towards the opponents goal. The obstructions are disposed in a predetermined pattern which creates lanes or alleys of decreasing width with respect to the length and width of the game board.

8 Claims, 7 Drawing Figures

FIG. 1
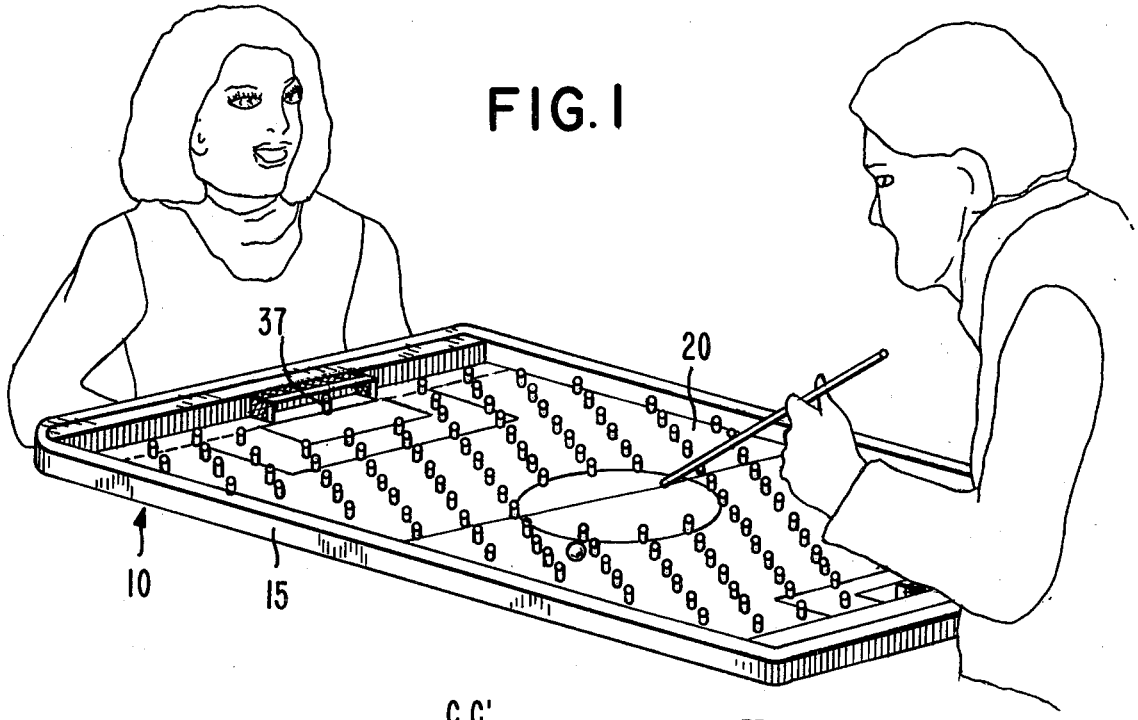
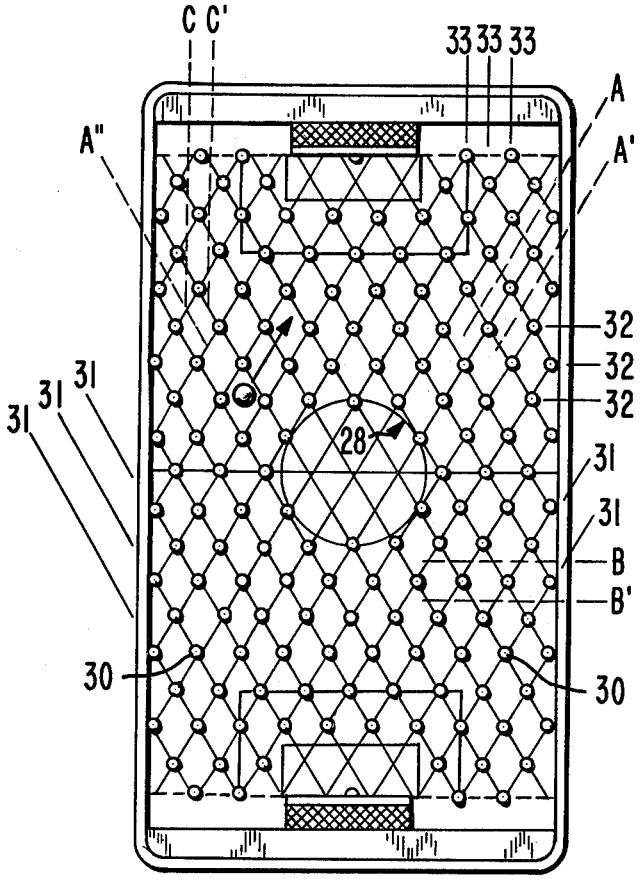
FIG. 2

FIG. 3
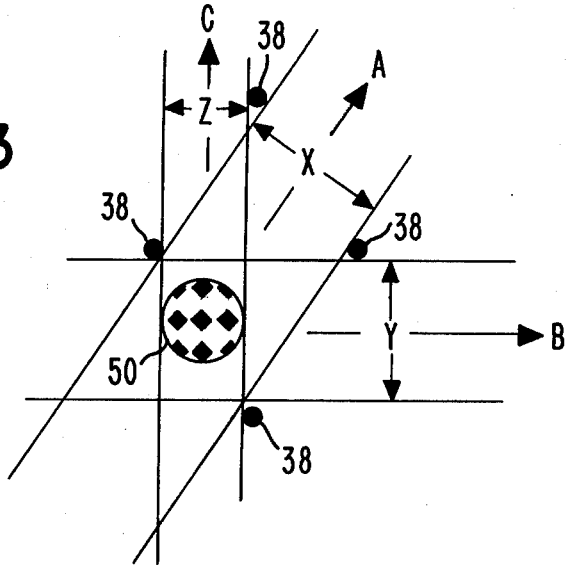
FIG. 4
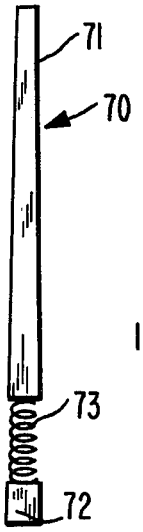
FIG. 5
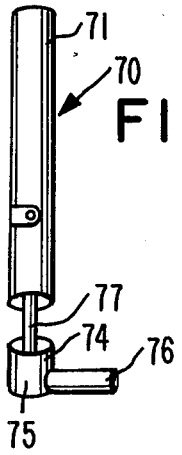
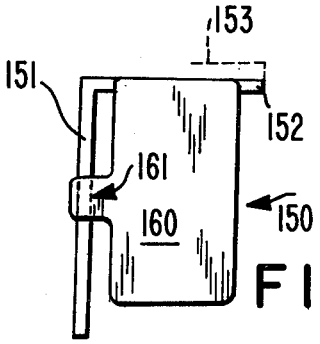
FIG. 7
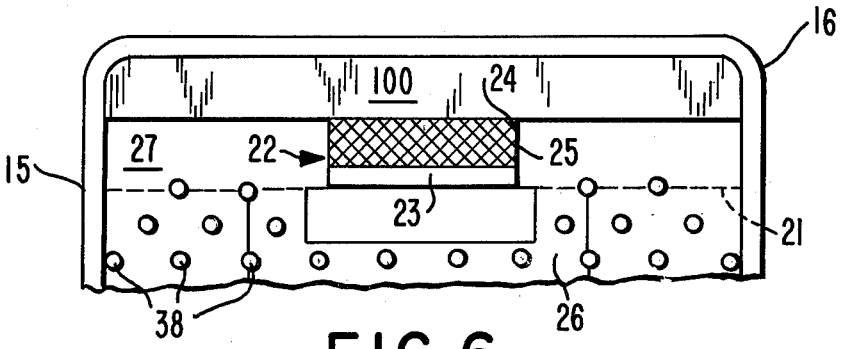
FIG. 6

COMBINATION SOCCER/HOCKEY GAME BOARD

BACKGROUND OF THE INVENTION

This invention contains the same subject matter as the contents of Disclosure Document 68509 filed February 13, 1978 in the United States Patent and Trademark Office.

Soccer which is the most popular spectator sport in the world has recently gained in popularity in the United States to the point where it is now rivaling baseball as the largest participant sport in this country. To date there have only been a handful of simulated soccer type games representations of which can be found in U.S. Pat. Nos. 4,025,073; 4,009,881; 4,018,443; 4,007,932 and 4,042,239 which would allow the players to recreate the strategy and movement of a soccer ball on a playing field.

Most of the prior art devices are large and cumbersome, expensive to manufacture, involve complex mechanical linkages and require highly developed manual dexterity techniques for their operation. These games also are deficient in restricting the number of players that can be actively involved and participate in the playing of the game. These games are further plagued by multiple components which can be broken or misplaced thereby preventing the game from functioning in its intended manner.

To date there has not be a simple, compact, inexpensive simulted soccer game devised which very closely approximates the movement of the soccer ball across the playing field in an actual game, which forces or encourages the players to use the same strategy which is employed under actual playing conditions, and yet is simple to understand, operate and enjoy.

SUMMARY OF THE INVENTION

An object of the present invention is the provision of a game board employing a rolling sphere which can be used to simulate the sports of hockey or soccer.

A further object of the present invention is the provision of a game board which will allow unobstructed travel of a rolling sphere in some directions and limited travel in other directions.

Still another object of the instant invention is the provision of a game board having a plurality of obstructions disposed on its surface in a predetermined arrangement to provide lanes along which a rolling sphere may be propelled to advance the sphere towards an opponents goal.

Another object of this invention is the provision of a game board which is simple and economical to manufacture and by virtue of its design forces or encourages the players to employ the same tactics and strategy used under actual playing conditions.

A further object of this invention is the provision of a simulated soccer game which will allow several players to actively participate in the playing of the game while providing many hours of enjoyment for the participants.

These and other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of the game board of the instant invention.

FIG. 2 is a top plane view of the game board showing the arrangement of the pegs and the lanes which they create.

FIG. 3 is a detailed sectional view of the pegs showing their displacement relative to one another and the progressively diminishing lanes of travel for the rolling sphere.

FIGS. 4 and 5 show various instruments used to propel the rolling sphere.

FIG. 6 shows the removeable insert employed in one version of the game board to instantly convert the playing surface from a soccer field to a hockey ring.

FIG. 7 is a detailed view of a removeable peg which is designed to be selectively disposed on said game board.

DESCRIPTION OF THE PREFERRED EMBODIMENT

As can be seen by reference to FIG. 1 the game board is designated generally as 10 and comprises a raised wall portion 15 surrounding a generally rectangular flat playing surface 20 having a plurality of obstructions 30 vertically projecting therefrom to form lanes or alleys which restrict or permit the passage of a rolling sphere 50 upon the playing surface.

In the preferred embodiment shown the playing surface 20 has markings 21 formed thereon to simulate a miniature soccer field. It should be obvious however that this playing surface could be modified slightly to simulate a hockey rink as will be explained further on. Positioned at either end and centrally disposed on the playing surface are two goals 22 comprising an upright U-shaped support member 23 having rearwardly projecting extensions 24 which support a net 25 into which the rolling sphere 50 is intended to be propelled in order for a player to score.

Referring now to FIGS. 2 and 3 it can be seen that the obstructions 30 are arranged in rows 31, 32, and 33 disposed on the playing surface in a specific pattern. The unique aspect of this pattern is that it forms a plurality of parallel lanes A, A′ etc., B, B′ etc. and C, C′ etc. whose width varies in relation to the angle of the rows of obstructions 31, 32 and 33 relative to the longitudinal of the playing surface.

The lanes A, A′ etc. are formed by the rows 31 which are disposed at an angle of between $\pm 20°$ to $\pm 70°$ from the longitudinal axis of the playing surface. The lanes B, B′ etc. are formed by the transverse rows 32 which are disposed perpendicular to the longitudinal axis of the playing surface, and the lanes C, C′ etc. are formed by the rows 33 which are disposed parallel to the longitudinal axis of the playing surface.

The width between the rows 31 which form the lanes A, A′ etc. is designated as X and is at least twice the diameter of the rolling sphere 50. The width between the rows 32, which form the lanes B, B′ etc. is designated as Y and is more than twice the diameter of the sphere 50 and the width between the rows 33 which form the lanes C, C′ etc. is designated Z and is the same or less than the diameter of the sphere 50.

The positioning and spacing of the obstructions 30 is crucial to this invention in that it virtually forces the players to use the same strategy and tactics employed in an actual game. A direct frontal attack on an opponents goal is rarely tried and infrequently successful due to the number of defenders which can interpose themselves into the path of the ball. The passes by the attacking team are usually towards the opponents goal on the diagonal and less frequently side to side or cross field.

The path of average or medium resistance for the rolling sphere 50 is on the diagonal along lanes A, A' etc. due to the width X between the rows 31 of the obstruction 30. The width of the lanes B, B' etc. between the rows 32 offer less of an obstruction to the passage of the sphere 50, and allow relatively unimpeded travel towards the goal posts, while the width Z of the lanes C, C' etc. make it virtually if not totally impossible for the sphere 50 to travel in the longitudinal direction any substantial distance without striking an obstruction 30 and altering its path of travel.

The location of the obstruction 30 is determined in the following manner. The rectangular playing surface is bisected by diagonal lines initiating at the corners of the simulated playing field. The point where there lines intersect is the center of the field, and then a plurality of equally spaced lines parallel to the original two lines form a grid intersecting lines. Each point of intersection on the grid represents the position of one of the obstructions 30 with the following exceptions; the area immediately in front of, to the sides of, and in the mouth of the goal; at the four corners of the playing field; and in the center of the playing field. It should be noted that the playing field 26, is distinguished herein from the playing surface 20, in that the latter includes the out of bounds area 27 at both ends of the field. In the preferred embodiment illustrated, a circle 28 whose center coincides with the center of the playing field, and whose circumference coincides with a plurality of the intersections, delineates the starting position for the game. All of the intersections within this area are devoid of obstructions 30 with the exception of the intersection closest to the center of its respective goal mouth. Positioned at the midpoint of each goal mouth is an obstruction 37 which represents the goal keeper.

The obstructions 30 are in the form of pegs 38, which may be cylindrical or tapered in configuration, but have uniform dimensions and sufficient height and rigidity to deflect the sphere 50 when it is propelled against them. The obstruction 37 which represents the goal keeper as well as any other obstructions (optional) which are intended to represent players on the field may have larger dimensions than the surrounding pegs 38 and may bear visual indicia representative of opposing teams.

As can best be seen by reference to FIG. 2 there are very few of the diagonal lanes A, A' etc. which will allow the passage of the propelled sphere into the goal mouth past the obstruction 37 representing the goal keeper.

Referring now to FIGS. 4 and 5, two sticks 70 are shown for propelling the sphere or simulated hockey puck. Obviously any narrow elongated striking member having a flat striking surface could be used to propel the sphere on the playing surface. FIG. 4 shows one proposed embodiment wherein the striking member 70 comprises an elongated upper portion 71 resiliently connected to a flat kicking end 72 via a coil spring element 73. FIG. 5 shows another proposed embodiment wherein the striking member 70 comprises an elongated upper portion 71 resiliently connected via a leaf or flat spring element 77 to a lower portion 74 in the shape of a foot or shoe 75 having a flat kicking end 76. Both of the embodiments illustrated employ a resiliently biased two piece striking stick, with the lower piece bearing the striking surface. The operation of these striking members 70 should be self explanatory.

The game is played as follows: a coin is flipped and the winner has the option to choose goals or to kick first; depending on the election, the first player to propel the sphere is determined; a stick 70 or similar member (FIGS. 4 and 5) is manually grasped and used to propel the sphere towards the opponent's goal; due to the staggered arrangement of the obstructions, the difficulty in propelling the sphere in a straight line, and contact of the sphere with the surrounding wall 15, many deflections and rebounds from the intended path are experienced; when the sphere stops rolling on the playing surface, the second player has an opportunity to propel it towards his opponent's goal; the players repeat this procedure until one of them is successful in scoring a goal; the ball is returned to the center and the game resumes with the player against which the goal was scored taking the first shot or kick.

If the sphere is propelled out of bounds 27 by the opponent's goal the opponent is allowed a goal kick from the corner of the small box in front of his goal. If the player inadvertently causes the ball or sphere to go out of bounds 27 near his own goal, the opponent is entitled to a corner kick 21 from the side of the field that the sphere went out of bounds on. This procedure explains the absence of the pegs 38 at the corners of the playing field and in the vicinity of the respective goal mouths. The pegs which have been deleted from the vicinity of the goal mouth also facilitate scoring when a player has a shot relatively close to his opponent's goal.

The game board for soccer may be fabricated from green colored high impact plastic or similar material with white lines painted thereon to represent a simulated soccer field. While the interior of the walls 15 surrounding the playing surface 20 rise vertically therefrom, the exterior surfaces are rounded as at 16 for obvious safety reasons. The obstructions 30 may be molded integrally with the playing surface 20, or in an alternate embodiment separate pieces or removable pegs would fit into apertures (not shown) in the playing surface. The removable aspect of the pegs 38 in the alternate embodiment allows the players to selectively remove or add pegs at the intersections of the grid to make it easier or more difficult for the players to score depending on their age level and manual dexterity.

As special removable peg 150 is illustrated in FIG. 7, and is intended to be used in conjunction with the removable pegs or obstructions 30 and apertures (not shown) of the alternate embodiment. The special peg 150 comprises a generally cylindrical upright post 151 having a cantilevered extension 152 projecting perpendicularly from its topmost end. A rigid flap member 160 is pivotally suspended from the extension 152, and is provided with a projection 161, which is disposed adjacent to, and cooperates with, the upright post 151.

A rolling sphere 50 traveling towards the viewer in FIG.7 would strike the rigid flap member 160 causing the flap member 160 to pivot on the extension 152. Depending upon the striking force of the sphere 50, the flap 160 will pivot approximately 360° about the extension 152 so that the projections 161 will cooperate with the rearward face of the post 151, or the flap member 160 will return to the position shown in FIG. 7.

A rolling sphere 50 traveling away from the viewer in FIG. 7, regardless of the striking force imparted to the flap member 160, will be repelled backwards by contact of the projection 161 with the upright post 151.

Should one-way travel of the sphere 50 be desired, the special peg 150 can be provided with a stop member 153 (shown in Phantom), which will prevent total rotation of the flap member 160 about the extension 152.

Obviously selective and judicious placement of the special peg 150 at several locations on the game board, will add a new dimension, and variety for the players as their level of skill progresses.

In the hockey version of this game board the playing surface 20 would bear markings similar to a hockey rink, the corners of the playing surface would be rounded and the goals would be located in from the ends of the playing surface to allow the passage of a propelled disk or sphere in back of the goal. The hockey version would incorporate some removable pegs at least along the sides of the playing surface to accommodate clearing passes, and also in the vicinity of the various face-off circles. This can be accomplished with very little modification to the preferred embodiment, as seen in FIG. 6, by having a removable insert 100 which would be flush with the back of the net and extending across the game board to square-off the playing surface for the soccer version, and when removed would provide the curved corners and clearance behind the net for a simulated hockey puck.

having hereby disclosed the subject matter of this invention it should be obvious that many modifications, substitutions and variations of the invention are possible in light of the above teachings. It is therefore to be understood, that the invention may be practiced other than as specifically described, and should be limited only by the breadth and scope of the appended claims.

What I claim is:

1. A combination soccer/hockey game board for use with a rolling sphere comprising;

a playing surface surrounded by a vertical wall member, a plurality of obstructions disposed on said playing surface in rows which extend in four directions, said rows from lanes which permit the rolling sphere to travel in three of said directions, while impeding the travel of said sphere in the fourth direction, two goal elements are positioned at opposite ends of the playing surface having obstructions disposed at the mid-point of their respective openings, a plurality of removable wall member elements disposed behind the respective goal elements, the presence of which conforms the playing surface to a soccer field, and the absence of which conforms the playing surface to a hockey ring.

2. A combination soccer/hockey game as in claim 1; wherein, a portion of the playing surface is divided by a grid formed by a plurality of intersecting diagonal lines, and said obstructions are selectively disposed at the points of intersection.

3. A combination soccer/hockey game board as in claim 2; wherein, the rows extend in the longitudinal, traverse and two diagonal directions, and the width of the lanes formed by the rows extending in the different directions varies.

4. A combination soccer/hockey game board as in claim 3; wherein, said obstructions are removeably disposed on said playing surface.

5. A combination soccer/hockey game board as in claim 3; wherein, said obstructions are formed integrally with said playing surface.

6. A combination soccer/hockey game board as in claim 3; wherein, some of said plurality of obstructions are removeably disposed on said playing surface, and the remaining plurality of obstructions are formed integrally with said playing surface.

7. A combination soccer/hockey game board as in claim 2; wherein, certain contiguous points of intersection are devoid of obstructions.

8. A combination soccer/hockey game board as in claim 7; wherein, said obstructions are in the form of pegs.

* * * * *